US007051921B1

(12) United States Patent
Borgognone

(10) Patent No.: US 7,051,921 B1
(45) Date of Patent: May 30, 2006

(54) SECURITY MAILBOX FOR PREVENTING UNAUTHORIZED ACCESS TO MAIL

(76) Inventor: Ronald L. Borgognone, 2095 La Fond Dr., Reno, NV (US) 89509

( * ) Notice: Subject to any disclaimer, the term of this patent is extended or adjusted under 35 U.S.C. 154(b) by 20 days.

(21) Appl. No.: 10/911,428

(22) Filed: Aug. 5, 2004

(51) Int. Cl.
*B65G 11/04* (2006.01)

(52) U.S. Cl. ..... 232/45; 232/43.1

(58) Field of Classification Search ..... 232/45, 232/17, 47, 48, 43.1, 24
See application file for complete search history.

(56) References Cited

U.S. PATENT DOCUMENTS

| | | | | |
|---|---|---|---|---|
| 1,096,040 | A * | 5/1914 | Ligush et al. | 232/47 |
| 3,735,919 | A * | 5/1973 | Morgan | 232/17 |
| 3,758,027 | A * | 9/1973 | Morgan | 232/17 |
| 4,724,999 | A * | 2/1988 | Fitzgerald et al. | 232/17 |
| 4,753,386 | A * | 6/1988 | Phillion, Sr. | 232/43.1 |
| 5,096,115 | A * | 3/1992 | Hassan | 232/17 |
| 5,178,320 | A * | 1/1993 | Bertone | 232/17 |
| D354,610 | S | 1/1995 | Hassan | |
| 5,617,993 | A | 4/1997 | Morris | |
| 5,833,132 | A | 11/1998 | Bachmeier | |
| 5,938,113 | A | 8/1999 | Kim | |
| 6,244,505 | B1 | 6/2001 | Grimes et al. | |
| 6,247,642 | B1 | 6/2001 | Wilson, Jr. | |
| D468,887 | S | 1/2003 | Shreve | |
| 6,533,167 | B1 | 3/2003 | Hassan | |
| 6,644,543 | B1 * | 11/2003 | Cox et al. | 232/47 |
| 6,942,141 | B1 * | 9/2005 | Swift | 232/47 |
| 2004/0074957 | A1 * | 4/2004 | Devar | 232/17 |

* cited by examiner

*Primary Examiner*—William L. Miller

(57) ABSTRACT

A security mailbox includes a housing having front and rear walls defining upper and lower compartments therebetween and front and rear access doors mounted to the front and rear walls. The housing further has top and bottom surfaces secured to the front and rear walls. The front access door has a fulcrum axis extending along a width thereof and a weight member secured to same and extending along the fulcrum axis for conveniently maintaining the front access door at a closed position. The mail box also includes L-shaped brackets secured to inner surfaces of the front and rear walls and a support shelf positionable within the housing. The rear access door is disposed adjacent the lower compartment and includes a lock attached thereto for allowing only authorized users to access mail therein.

15 Claims, 4 Drawing Sheets

SECURITY MAILBOX FOR PREVENTING UNAUTHORIZED ACCESS TO MAIL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a mail box and, more particularly, to a security mail box for preventing unauthorized access to mail.

2. Prior Art

Curb-side residential mailboxes are commonly used as a convenient location for the postal carrier to deliver mail, including letters and small packages. They also allow a convenient location for outgoing mail to be left for the postal carrier to collect. Mailboxes should keep the mail dry, be easily accessed and should readily identify the street address. While conventional designs have accomplished these functions, there is a continuing interest in improving the security, construction and aesthetics of residential mailboxes.

Although federal laws exist that punish the theft of mail, problems with theft of mail, particularly financial documents such as social security, retirement, and pension checks, as well as financial statements that include bank documents and credit cards, exist. Suburban and rural mailboxes are also subject to vandalism and destruction, including the placement of explosive devices inside mailboxes by those bent on acts of mischief and vandalism.

Another concern to many users of mailboxes in rural areas, towns and villages would be having their valuable mail stored in a safe manner and without interruption of daily mail delivery, while having the flexibility of storing mail for a long period of time while they are away and allowing them to retrieve stored mail at a later date when they return.

Accordingly, a need remains for a security mail box for preventing unauthorized access to mail in order to overcome the above-noted shortcomings. The present invention satisfies such a need by providing a mailbox with adequate safety features and storage space where homeowners can leave their mail throughout the day, or for extended periods of time, while having the peace of mind that their mail will not be tampered with.

BRIEF SUMMARY OF THE INVENTION

In view of the foregoing background, it is therefore an object of the present invention to provide a mail box for preventing unauthorized access to mail. These and other objects, features, and advantages of the invention are provided by a mailbox for receiving and storing mail therein. The mailbox includes a housing having spaced front and rear walls defining upper and lower compartments therebetween.

Such an upper compartment is shaped and sized to approximately one-third a volume of the lower compartment.

The housing preferably has a centrally disposed longitudinal axis with the support shelf (described herein below) axially centered thereabout. The housing includes a plurality of access doors formed from rigid material, which are pivotally mounted to the front and rear walls respectively, and are movable along first and second radial paths respectively. Such a front access door is disposed above the rear access door. The present invention also includes a plurality of L-shaped brackets secured to inner surfaces of the front and rear walls respectively and subjacent to the first access door.

The housing further has top and bottom surfaces secured to the front and rear walls for defining a predetermined height of the housing. The first access door has a fulcrum axis extending along a width thereof. The second access door may be disposed adjacent to the lower compartment for conveniently allowing a user to retrieve mail therefrom. Such a second access door includes a lock attached thereto for advantageously allowing only authorized access to the lower compartment.

The mail box further includes a support shelf having substantially planar upper and lower surfaces removably positionable within the housing and engageable with the brackets respectively wherein the support shelf is disposed along a horizontal plane rearward of the first access door. Such a support shelf advantageously receives and supports mail thereon and within the upper compartment so that a user can readily retrieve mail via the first access door.

The support shelf preferably includes a lever attached thereto and extending upwardly therefrom so that a user can effectively remove the support shelf as needed.

The present invention further includes a weight member having an arcuate shape provided with an apex movable along the first radial path. Such a weight member is secured to the front access door and extends along the fulcrum axis for conveniently maintaining the front access door at a closed position. The weight member preferably extends rearwardly from the first access door and is spaced within the upper compartment. The fulcrum axis is defined along a lower edge portion of the first access door.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
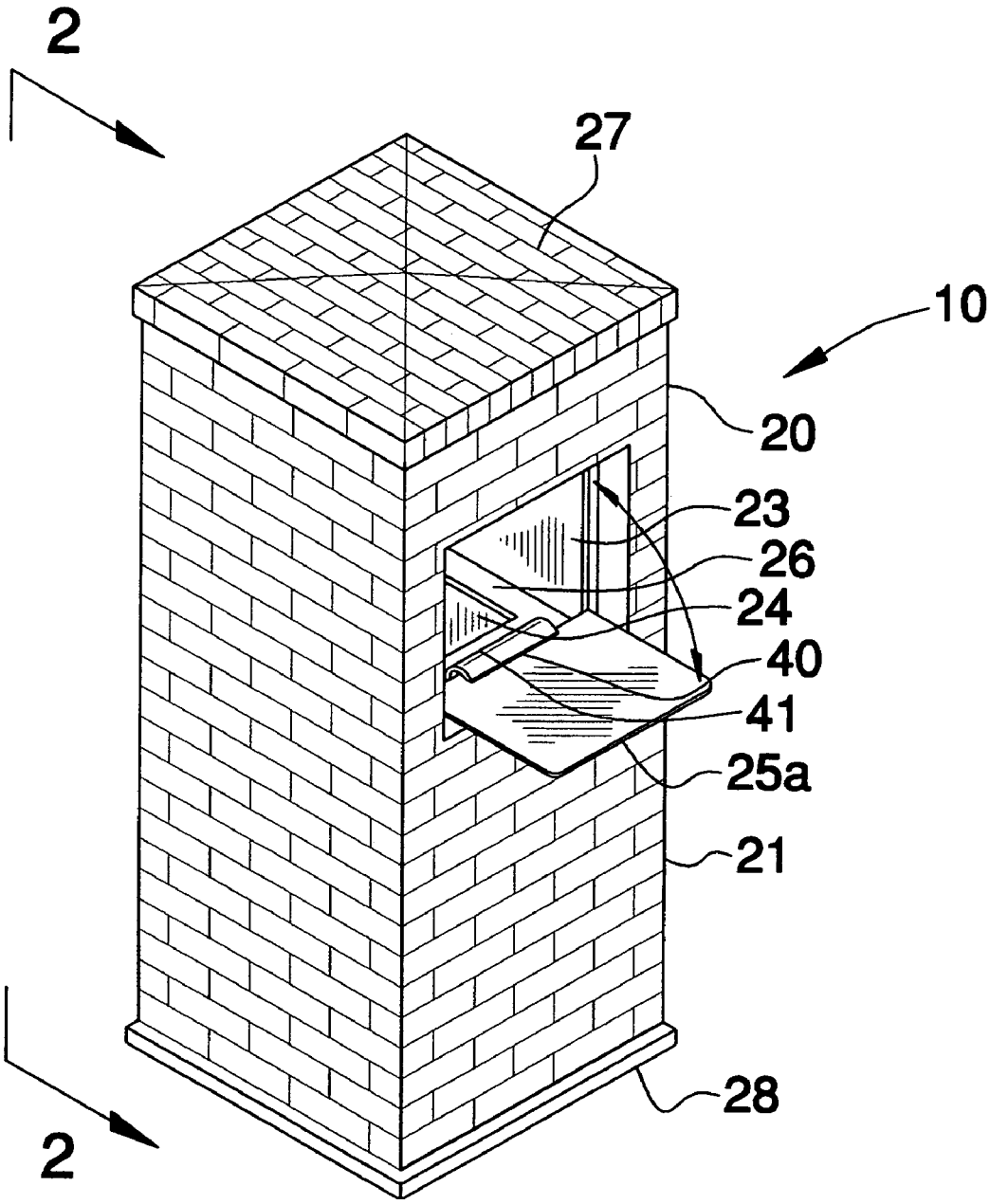
FIG. 1 is a perspective view showing a security mail box for preventing unauthorized access to mail, in accordance with the present invention.
Figure 2:
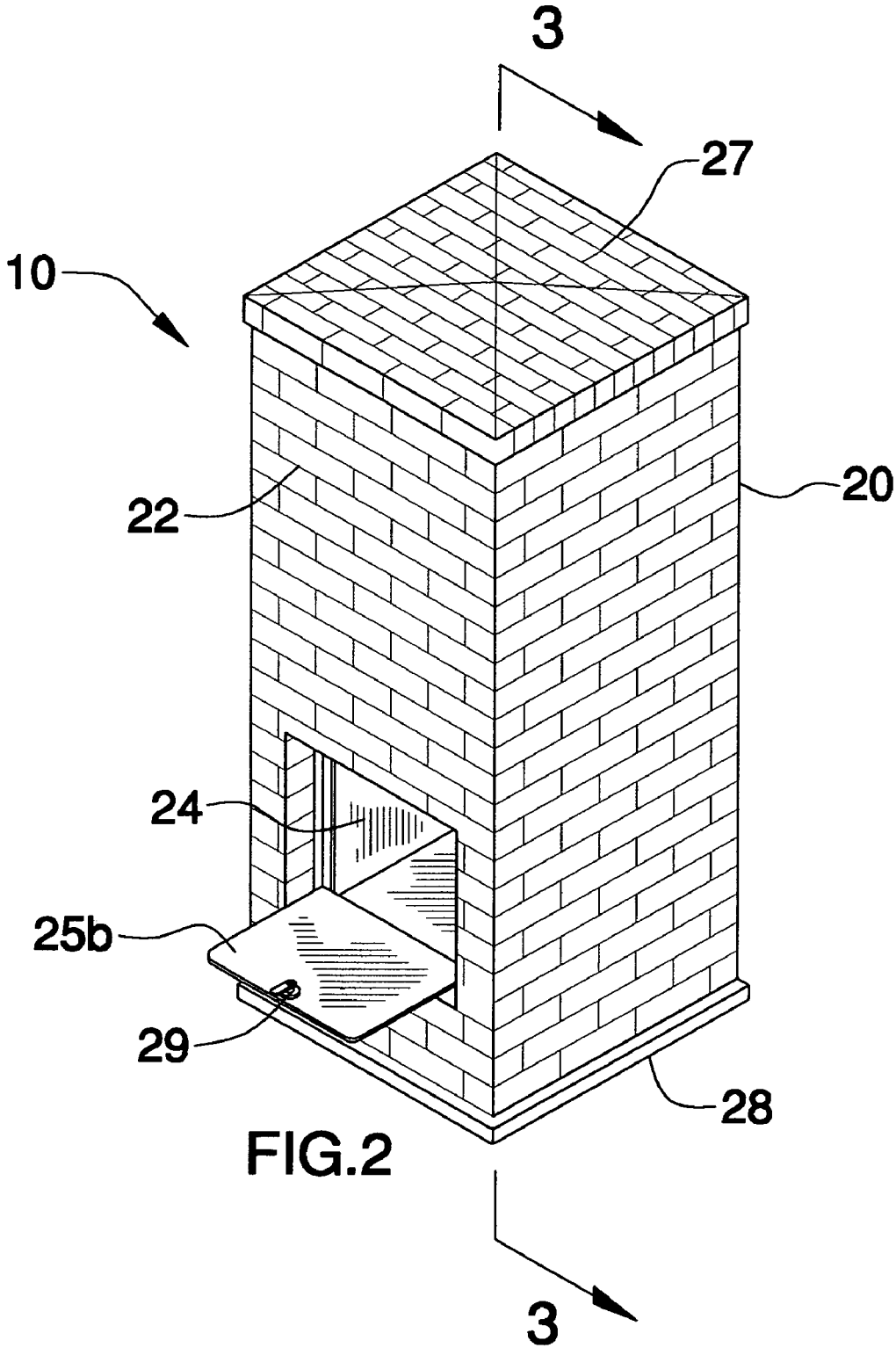
FIG. 2 is a rear elevational view of the mail box shown in FIG. 1, along line 2—2.
Figure 3:
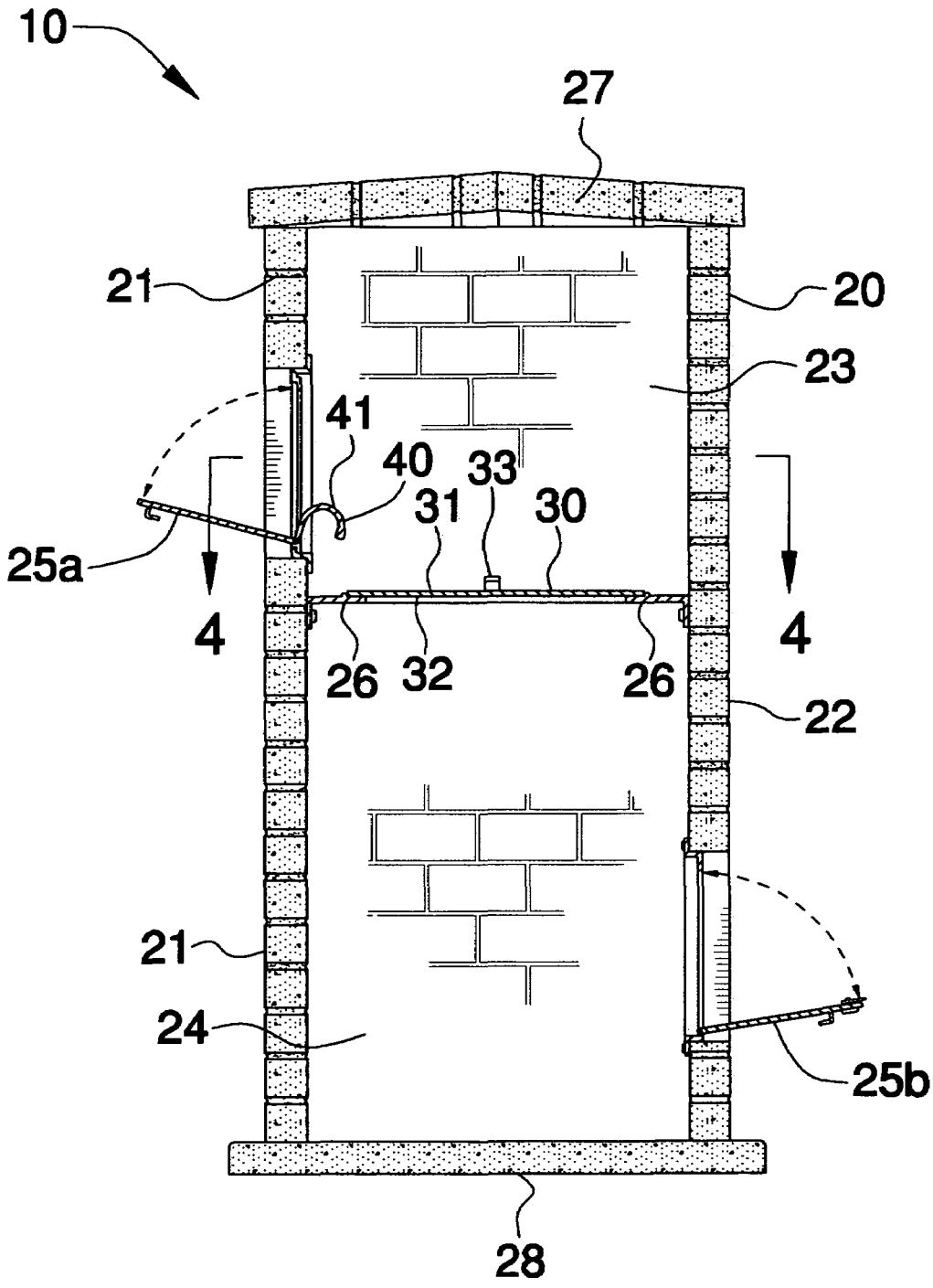
FIG. 3 is an enlarged cross-sectional view of the mail box shown in FIG. 1, taken along line 3—3.
Figure 4:
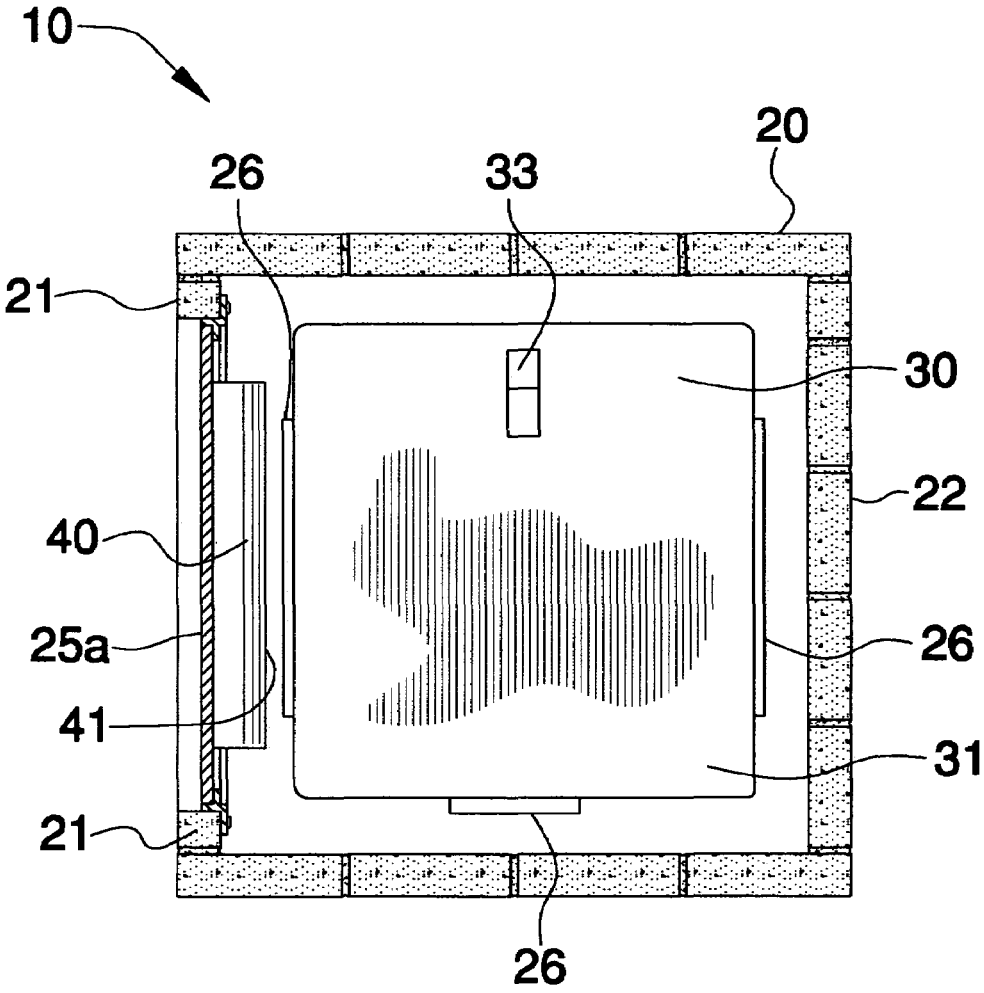
FIG. 4 is an enlarged cross-sectional view of the mail box shown in FIG. 3, taken along line 4—4.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a security mail box for preventing unauthorized access to mail. It should be understood that the apparatus 10 may be used to secure many different types of mail boxes and should not be limited to only residential mail boxes.

Referring initially to FIG. 1, the apparatus 10 includes a housing 20 having spaced front 21 and rear 22 walls defining upper 23 and lower 24 compartments therebetween. Such an upper compartment 23 is shaped and sized to approximately one-third a volume of the lower compartment 24, advantageously allowing such a lower compartment 24 to store an amount of mail in excess of the amount that the upper compartment 23 can receive. This feature allows an individual to not retrieve mail for a period of time while not having to worry about the lower compartment 24 becoming too full.

The housing 20 has a centrally disposed longitudinal axis with the support shelf 30 (described herein below) axially centered thereabout. The housing includes a plurality of access doors 25*a, b* formed from rigid material, which are pivotally mounted to the front 21 and rear 22 walls respectively, and are movable along first and second radial paths respectively. Such a front access door 25*a* is disposed above the rear access door 25*b*. The present invention also includes a plurality of L-shaped brackets 26 secured to inner surfaces of the front 21 and rear walls 22 respectively and subjacent to the first access 25*a* door.

The housing further has top 27 and bottom 28 surfaces secured to the front 21 and rear 22 walls for defining a predetermined height of the housing 20. Such a top surface 27 advantageously further prevents access to mail that is delivered to the mailbox 10, improving the safety features of the same. The first access door 25*a* has a fulcrum axis extending along a width thereof. The second access door 25*b* is disposed adjacent to the lower compartment 24 for conveniently allowing a user to retrieve mail therefrom. Such a second access door 25*b* includes a lock 29 attached thereto for advantageously allowing only authorized access to the lower compartment.

The mail box further includes a support shelf 30 having substantially planar upper 31 and lower 32 surfaces removably positionable within the housing 20 and engageable with the brackets 26 respectively wherein the support shelf 30 is disposed along a horizontal plane rearward of the first access door 25*a*. Such a support shelf 30 advantageously receives and supports mail thereon and within the upper compartment 23 so that a user can readily retrieve mail via the first access door 25*a*.

The support shelf 30 includes a lever 33 attached thereto and extending upwardly therefrom so that a user can effectively remove the support shelf 30 as needed. By doing so a user effectively allows the mail to be dropped directly into the lower compartment 24, which advantageously prevents unauthorized individuals access to any delivered mail. This feature also advantageously allows the user to leave the mailbox unattended for a period of time without worrying about the safety of their delivered mail.

The present invention further includes a weight member 40 having an arcuate shape provided with an apex 41 movable along the first radial path. Such a weight member 40 is secured to the front access door 25*a* and extends along the fulcrum axis for conveniently maintaining the front access door 25*a* at a closed position. The weight member 40 extends rearwardly from the first access door 25*a* and is spaced within the upper compartment 23. The fulcrum axis is defined along a lower edge portion of the first access door 25*a*.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A mailbox for receiving and storing mail therein, said mailbox comprising:

a housing having spaced front and rear walls defining upper and lower compartments therebetween, said housing comprising a plurality of access doors pivotally mounted to said front and rear walls respectively and being movable along first and second radial paths respectively, said front access door being disposed above said rear access door, said housing further having top and bottom surfaces secured to said front and rear walls for defining a predetermined height of said housing, said front access door having a fulcrum axis extending along a width thereof, a plurality of brackets secured to inner surfaces of said front and rear walls respectively and subjacent to said front access door, a support shelf removably positionable within said housing and engageable with said brackets respectively wherein said support shelf is disposed along a horizontal plane rearward of said front access door, wherein said shelf support includes a lever attached thereto and extending upwardly therefrom so that a user can completely remove said support shelf from said housing for allowing mail to be dropped directly into said lower compartment, said support shelf for receiving and supporting mail thereon and within said upper compartment so that a user can readily retrieve mail via said front access door, and a weight member secured to said front access door and extending along the fulcrum axis for maintaining said front access door at a closed position, the fulcrum axis being defined along a lower edge portion of said front access door.

2. The mailbox of claim 1, wherein said weight member extends rearwardly from said front access door and is spaced within said upper compartment.

3. The mailbox of claim 1, wherein said rear access door is disposed adjacent said lower compartment and for allowing a user to retrieve mail therefrom, said rear access door comprising a lock attached thereto and for allowing only authorized access to said lower compartment.

4. The mailbox of claim 1, wherein said weight member has an arcuate shape provided with an apex movable along the first radial path.

5. The mailbox of claim 1, wherein said housing has a centrally disposed longitudinal axis with said support shelf being axially centered thereabout.

6. A mailbox for receiving and storing mail therein, said mailbox comprising:

a housing having spaced front and rear walls defining upper and lower compartments therebetween, wherein said shelf support includes a lever attached thereto and extending upwardly therefrom so that a user can completely remove said support shelf from said housing for allowing mail to be dropped directly into said lower compartment, said housing comprising a plurality of access doors formed from rigid material and being pivotally mounted to said front and rear walls respectively and being movable along first and second radial paths respectively, said front access door being disposed above said rear access door, said housing further having top and bottom surfaces secured to said front and rear walls for defining a predetermined height of said housing, said front access door having a fulcrum axis extending along a width thereof, a plurality of L-shaped brackets secured to inner surfaces of said front and rear walls respectively and subjacent to said front access door, a support shelf removably positionable within said housing and engageable with said brackets respectively wherein said support shelf is disposed along a horizontal plane rearward of said front access door, said support shelf for receiving and supporting mail thereon and within said upper compartment so that a user can readily retrieve mail via said front access door, and a weight member secured to said front access door and extending along the fulcrum axis for maintaining said front access door at a closed position, the fulcrum axis being defined along a lower edge portion of said front access door.

7. The mailbox of claim 6, wherein said weight member extends rearwardly from said front access door and is spaced within said upper compartment.

8. The mailbox of claim 6, wherein said rear access door is disposed adjacent said lower compartment and for allowing a user to retrieve mail therefrom, said rear access door comprising a lock attached thereto and for allowing only authorized access to said lower compartment.

9. The mailbox of claim 6, wherein said weight member has an arcuate shape provided with an apex movable along the first radial path.

10. The mailbox of claim 6, wherein said housing has a centrally disposed longitudinal axis with said support shelf being axially centered thereabout.

11. A mailbox for receiving and storing mail therein, said mailbox comprising:

a housing having spaced front and rear walls defining upper and lower compartments therebetween, said upper compartment being shaped and sized to approximately one-third a volume of said lower compartment, said housing comprising a plurality of access doors formed from rigid material and being pivotally mounted to said front and rear walls respectively and being movable along first and second radial paths respectively, said front access door being disposed above said rear access door, said housing further having top and bottom surfaces secured to said front and rear walls for defining a predetermined height of said housing, said front access door having a fulcrum axis extending along a width thereof, a plurality of L-shaped brackets secured to inner surfaces of said front and rear walls respectively and subjacent to said front access door, a support shelf having substantially planar upper and lower surfaces and being removably positionable within said housing and engageable with said brackets respectively wherein said support shelf is disposed along a horizontal plane rearward of said front access door, said support shelf for receiving and supporting mail thereon and within said upper compartment so that a user can readily retrieve mail via said front access door, and a weight member secured to said front access door and extending along the fulcrum axis for maintaining said front access door at a closed position, wherein said shelf support includes a lever attached thereto and extending upwardly therefrom so that a user can completely remove said support shelf from said housing for allowing mail to be dropped directly into said lower compartment, the fulcrum axis being defined along a lower edge portion of said front access door.

12. The mailbox of claim 11, wherein said weight member extends rearwardly from said front access door and is spaced within said upper compartment.

13. The mailbox of claim 11, wherein said rear access door is disposed adjacent said lower compartment and for allowing a user to retrieve mail therefrom, said rear access door comprising a lock attached thereto and for allowing only authorized access to said lower compartment.

14. The mailbox of claim 11, wherein said weight member has an arcuate shape provided with an apex movable along the first radial path.

15. The mailbox of claim 11, wherein said housing has a centrally disposed longitudinal axis with said support shelf being axially centered thereabout.

* * * * *